United States Patent [19]

Trapy

[11] Patent Number: 4,703,740

[45] Date of Patent: Nov. 3, 1987

[54] DEVICE FOR IMPROVING THE QUALITY OF THE CARBURETTED MIXTURE DELIVERED BY A PNEUMATIC INJECTION SYSTEM

[75] Inventor: Jean Trapy, Rueil Malmaison, France

[73] Assignees: Institut Francais du Petrole Automobiles Peugeout, Rueil-Malmaison; Automobiles Citroen, Paris & Seine, both of France

[21] Appl. No.: 814,751

[22] Filed: Dec. 30, 1985

[30] Foreign Application Priority Data

Dec. 28, 1984 [FR] France ..... 84 20057

[51] Int. Cl.[4] ..... F02M 69/08

[52] U.S. Cl. ..... 123/531

[58] Field of Search ..... 123/250, 292, 531, 532, 123/533, 534, 535, 585, 590

[56] References Cited

U.S. PATENT DOCUMENTS

| | | | |
|---|---|---|---|
| 943,684 | 12/1909 | Johnston | 123/531 X |
| 1,520,772 | 12/1924 | Ricardo | 123/531 X |
| 3,996,906 | 12/1976 | Bubniak et al. | 123/531 |
| 4,159,703 | 7/1979 | Mayer | 123/531 X |

FOREIGN PATENT DOCUMENTS

| | | | |
|---|---|---|---|
| 2314958 | 11/1973 | Fed. Rep. of Germany | 123/531 |
| 0270037 | 12/1929 | Italy | 123/531 |

*Primary Examiner*—Willis R. Wolfe, Jr.
*Attorney, Agent, or Firm*—Antonelli, Terry & Wands

[57] ABSTRACT

A device is provided for supplying a reciprocating internal combustion engine with carburetted mixture. In this device, the liquid fuel injector feeds an injection nozzle disposed in an injection prechamber.

8 Claims, 7 Drawing Figures

DEVICE FOR IMPROVING THE QUALITY OF THE CARBURETTED MIXTURE DELIVERED BY A PNEUMATIC INJECTION SYSTEM

BACKGROUND OF THE INVENTION

1. Field of the Invention

The present invention relates to a device for improving the quality of the carburetted mixture which is delivered by a pneumatic injection system feeding a reciprocating internal combustion engine.

2. Description of the Prior Art

Such engines are usually supplied, either by a carburettor, or by direct or indirect injection of the liquid fuel. In the first case, the prior mixture of air and fuel takes place appreciably upstream of the intake ports of the cylinders, which causes inhomogeneities both in the distribution of the fuel in the air and in the distribution of the mixture between the cylinders. These imperfections are prejudicial to the efficiency of the engine, all the more so since mixture may be lost to the exhaust when the cylinder is scavenged by the mixture admitted, (in particular in two stroke engines). Finally, controlling the amount of fuel in the air becomes very delicate when the carburetion must be optimized with a view to saving energy and reducing pollutants.

Direct or indirect injection of the liquid fuel palliates the harmful effects of a poor distribution between cylinders and losses to the exhaust, and facilitates control of the fuel.

It has however, the drawback of creating inhomogeneities of the mixture in the cylinders, which may result in poor combustion, particularly at high speeds.

A third method is still little used or not used at all in reciprocating engines, namely pneumatic injection.

This process combines the advantages of direct or indirect liquid injection with those of carburetion. In fact, the fluid mixture introduced is already a partly prepared carburetted mixture, distribution thereof may be independent for each cylinder and determined so as to minimize the losses to the exhaust.

The prior art may be illustrated by the following French Pat. Nos.: FR-A- 563 174, FR-A-313 652, FR-A-1 037 550 and FR-A-669 767.

The proposed invention concerns the arrangement of a pneumatic injector using a nozzle for improving the air-injected fuel mixture.

SUMMARY OF THE INVENTION

More particularly, the present invention relates to a device for improving the quality of the carburetted mixture which is delivered by a pneumatic injection system supplying a reciprocating internal combustion engine, the pneumatic injection system comprising a means for injecting the liquid fuel opening into an injection prechamber communicating with the combustion chamber of the engine.

This device further comprises more particularly at least two means for speeding up the carburetted mixture, the first of which comprises an injection nozzle disposed in the injection prechamber, said injection nozzle comprising an outlet edge and being supplied with liquid fuel by the fuel injection means.

The injection nozzle may be disposed coaxially with said prechamber.

The injection nozzle may be integral with the walls of said prechamber and have, substantially at the level of its neck, at least one lateral orifice into which opens at least one liquid fuel injection means.

The nozzle may be disposed so as to be substantially closed by an injection valve. The second speeding up means may be formed by the space defined by one wall of the valve and by the outlet edge of the nozzle.

The second speeding up means may comprise a fixed member having one end in the form of a tulip leaving a permanent opening, this member comprising a rod passing through the nozzle. The injection prechamber may be connected to a pressurized pulsed air source.

The second speeding up means may comprise a maximum passage section for the carburetted mixture between 20% and 80% of the total passage section of said chamber.

The means for injecting the fuel may be positioned in the prechamber so as to produce a jet in the direction of the internal surfaces of the nozzle.

When the device of the invention comprises an injection valve resting intermittently on a seat integral with the prechamber, the means for speeding up the carburetted mixture may be formed by the passage between the valve and its seat when said valve is in the open position.

BRIEF DESCRIPTION OF THE DRAWINGS

To better understand the features and advantages of the present invention, reference may be had to the following description and the accompanying drawings in which.

DESCRIPTION OF THE PREFERRED EMBODIMENTS

In the Figures, the combustion chamber 1 of a reciprocating internal combustion engine includes a cylinder head 2 comprising an injection orifice 3 causing an injection prechamber 4 to communicate with the combustion chamber 1.

Figure 1:
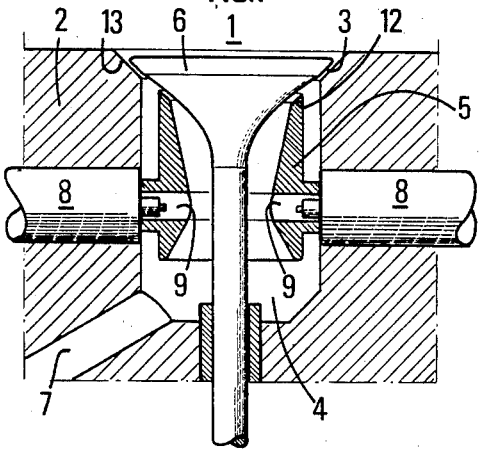
FIG. 1 shows schematically, in section, one embodiment of the injection device.

FIG. 1 shows the schematical section of one embodiment of a pneumatic injector equipped with a nozzle 5 substantially improving spraying of the fuel and the homogeneity of the injected mixture. The nozzle 5 is inserted in the prechamber 4, closed by the injection valve 6, and in which arrives a gas intake 7 containing oxygen, such as air, and one or more liquid fuel injectors 8.

These latter penetrate into the prechamber through the nozzle 5 and may, for example, be commercial electronic or mechanical injectors used currently in mass produced engines. The nozzle 5 includes an outlet edge 12. The nozzle forms a first means for speeding up the gases forming the carburetted mixture. Second means for speeding up these gases may be formed by the outlet edge 12 of the nozzle 5 and by the valve 6 or by the same valve 6 and the seat 13 of the valve 6.

The movements of the valve 6 may be caused by conventional control means, and the opening of the valve 6 controls the effective injection, by establishing an air flow through the prechamber 4 and nozzle 5, which sprays the fuel and drives it outside the injector. The liquid fuel may be introduced into the prechamber during opening of the valve, or else before such opening, the prechamber then serving as reserve. However, without departing from the scope of the invention, the air jet may be pulsed by a system other than the one of the valve 6, or the fuel may be controlled in amount and introduced into the prechamber 4 by a device other than commercial injectors. The injection nozzle 5 is substantially coaxial with the prechamber 4 and is disposed so as to be substantially closed at the same time as orifice 3 by the valve 6.

Figure 2:
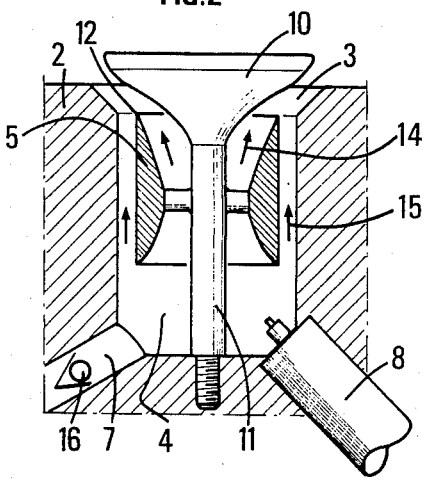
FIG. 2 illustrates a variant of the device of FIG. 1, with a fixed opening.

FIG. 2 shows one embodiment comprising a fixed member 10 having the general form of a tulip and associated with a nozzle 9 which is integral with its rod 11.

The fixed member 10 is mounted so as to leave the injection orifice 3 permanently open, the alternating injection process being provided by a pressurized pulsed air flow through duct 7. This embodiment is particularly well adapted for an indirect injection system. It may be housed in the cylinder head 2 or elsewhere, for example, in the intake manifold.

The injection orifice may serve as second means for speeding up the carburetted mixture. Similarly, the second means may be formed by the passage defined by the outlet edge 12 of the nozzle 5 and a tulip 10.

With this embodiment, there is, in particular, no need for an injection valve control system. It is however necessary to provide means 16 for preventing the back flow of the gases during combustion phases. This may be formed by means of a non return valve.

Equipped with the injection nozzle 5, the above described device allows a good quality carburetted mixture to be injected at high frequencies (higher than 100 Hz), for very small upstream-downstream pressure differences, down to 0.1 bar.

The maximum opening of the injection orifice 3 also forms an important parameter, for it regulates the speed of the air flow and it has been discovered that the results were satisfactory when the passage section of this opening is between 20% and 80% of the total passage cross section of the injection prechamber. It has also been discovered that the nozzle 5 allowed a much greater latitude for fixing the time of injection of the liquid fuel in the prechamber 4. However, without departing from the scope of the invention, valve 6 may be replaced by any other type of periodic closure means.

In accordance with the invention, it is important for the outlet edge 12 of the nozzle to be swept by an air flow passing through the nozzle 5 (arrows 4 in FIG. 2) and by an air flow passing outside the nozzle 5 (arrows 15 in FIG. 2). It is also important for the injection means 8 to direct the fuel jets on the internal walls of the nozzle 5.

Figure 3A:
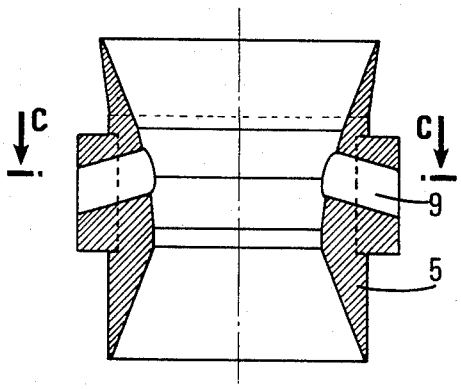
FIGS. 3A, 3B and 3C show one embodiment of the injection nozzle in longitudinal section, seen from the side and from above respectively, and FIGS. 4 and 5 compare the measured consumption of an engine supplied by pneumatic injection with and without the injection nozzle of the device of the invention.
Figure 3B:
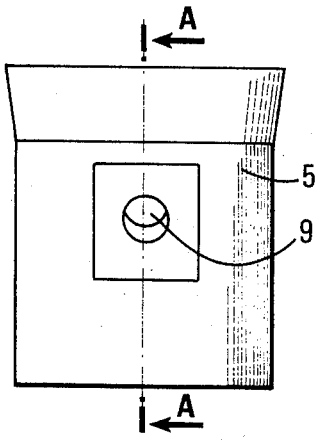
Figure 3C:
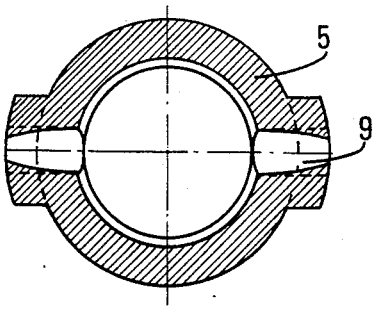

In FIG. 3 is shown the type of nozzle which has brought substantial improvements to the quality of the injected mixture.

The nozzle of FIG. 3 is characterized in that its portion on the gas outlet side is recessed over a certain length and that the outlet diameter is greater than the inlet diameter.

Figure 4:
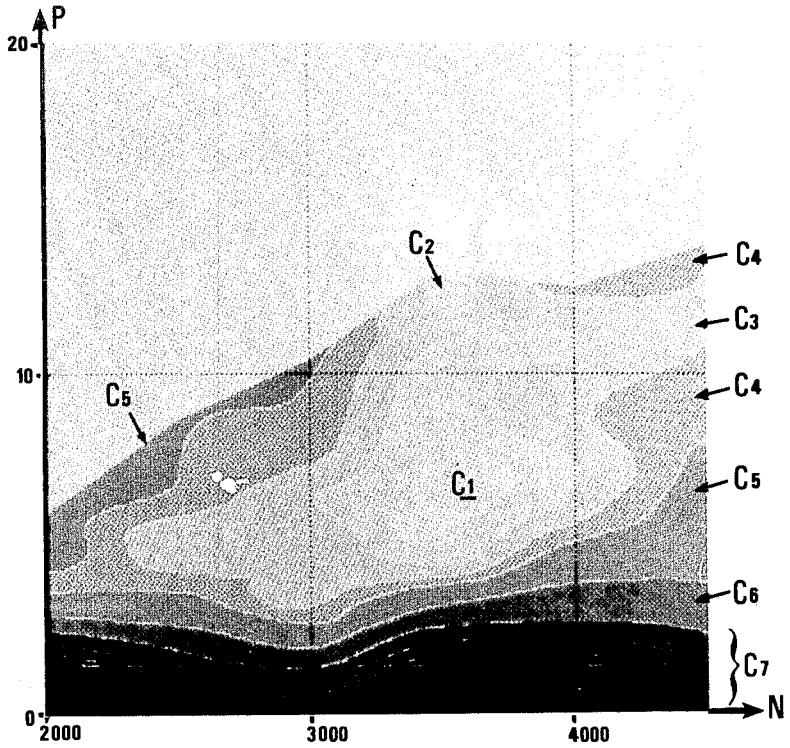
Figure 5:
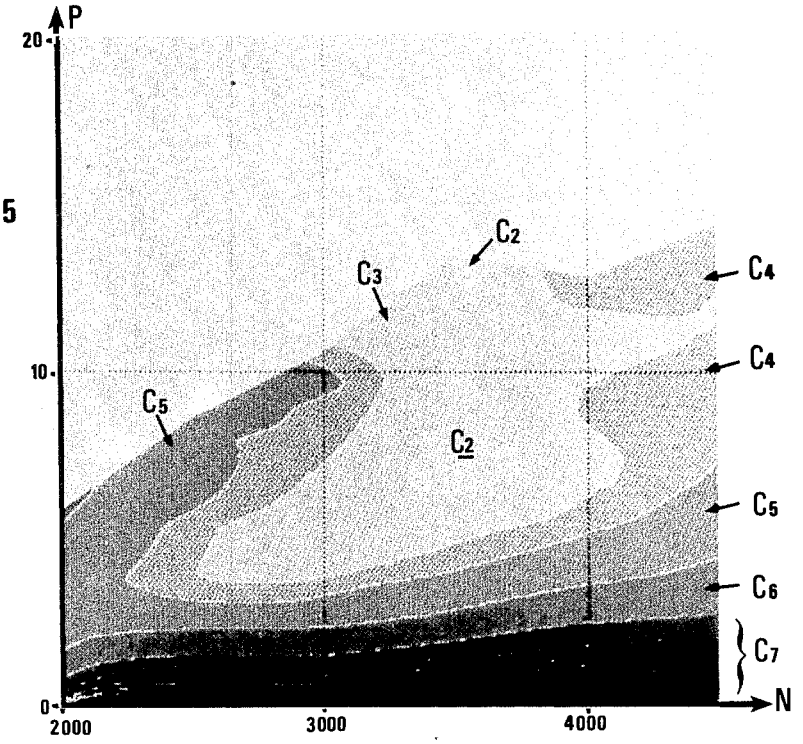

FIGS. 4 and 5 show, by way of comparison, isoconsumption charts of an engine fed by direct pneumatic injection, with (FIG. 4) and without (FIG. 5) an injection nozzle.

In FIGS. 4 and 5, the speed N of the engine in rpm has been shown as abscissa and the horse power P of the engine as ordinates.

The consumption is expressed in grams per horse power and per hour, the correspondance between the references and the consumptions is the following:

| REFERENCE OF THE ZONE | CONSUMPTION RANGE IN GRAMS PER HORSE POWER AND PER HOUR |
|---|---|
| $C_1$ | less than 190 |
| $C_2$ | between 190 and 200 |
| $C_3$ | between 200 and 210 |
| $C_4$ | between 210 and 220 |
| $C_5$ | between 220 and 250 |
| $C_6$ | between 250 and 300 |
| $C_7$ | more than 300. |

Comparison of FIGS. 4 and 5 shows the distinct improvement brought by using the nozzle 5.

What is claimed is:

1. A device for improving the quality of a carburetted mixture which is delivered by a pneumatic injection system supplying a reciprocating internal combustion engine, said pneumatic injection system comprising a means for injecting a liquid fuel opening into an injection prechamber communicating with a combustion chamber of the engine, said device further comprising at least two means for speeding up the carburetted mixture, the first speeding up means comprises an injection nozzle disposed in said injection prechamber, said injection nozzle comprising an outlet edge and being supplied with the liquid fuel by said fuel injection means, said injection nozzle is disposed coaxially with said prechamber, and wherein said second speeding up means comprises a fixed member having one end in the form of a tulip leaving a permanent opening, said member comprising a rod passing through said nozzle and said injection prechamber is connected to a pressurized pulsed air source.

2. A device for improving the quality of a carburetted mixture which is delivered by a pneumatic injection system supplying a reciprocating internal combustion engine, said pneumatic injection system comprising a means for injecting a liquid fuel opening into an injection prechamber communicating with a combustion chamber of the engine, said device further comprising at least two means for speeding up the carburetted mixture, the first speeding up means comprises an injection nozzle disposed in said injection prechamber, said injection nozzle comprising an outlet edge swept by a gas flow passing through said injection nozzle and being supplied with the liquid fuel by said fuel injection means.

3. The device as claimed in claim 2, wherein said second speeding up means comprises a maximum passage section for the carburetted mixture between 20% and 80% of the total passage section of said chamber.

4. The device as claimed in claim 2, wherein said fuel injection means is positioned in said prechamber so as to produce a jet in the direction of the internal surfaces of said injection nozzle.

5. The device as claimed in claim 2, wherein said injection nozzle is disposed coaxially with said prechamber.

6. The device as claimed in claim 5, wherein said injection nozzle is integral with the walls of said prechamber and has, substantially at the level of a neck thereof, at least one lateral orifice into which opens at least one liquid fuel injection means.

7. The device as claimed in any one of the claims 5 or 6, wherein said injection nozzle is disposed so as to be substantially closed by an injection valve, and wherein the second speeding up means are formed by the space defined by a wall of said valve and by said outlet edge of said nozzle.

8. The device as claimed in one of claims 5 or 6, comprising an injection valve, said valve resting intermittently on a valve seat integral with said prechamber, wherein said means for speeding up the carburetted mixture are formed by the passage between the injection valve and associated valve seat when said injection valve is in an open position.

* * * * *